US006007171A

United States Patent [19]

Varellas-Olree

[11] Patent Number: 6,007,171

[45] Date of Patent: Dec. 28, 1999

[54] CABINET WITH OVER-THE-TOP DOOR

[75] Inventor: Carolyn May Varellas-Olree, Caledonia, Mich.

[73] Assignee: Steelcase Development Inc., Grand Rapids, Mich.

[21] Appl. No.: 09/164,743

[22] Filed: Oct. 1, 1998

[51] Int. Cl.[6] ..... A47B 96/00

[52] U.S. Cl. ..... 312/323

[58] Field of Search ..... 312/139.1, 322, 312/323, 109; 49/152, 153, 154

[56] References Cited

U.S. PATENT DOCUMENTS

| | | | |
|---|---|---|---|
| Re. 28,994 | 10/1976 | Aylworth . | |
| D. 339,934 | 10/1993 | Reuter . | |
| 702,348 | 6/1902 | Forster | 312/109 |
| 1,384,530 | 7/1921 | Knauft . | |
| 1,879,798 | 9/1932 | Ferris . | |
| 1,940,408 | 12/1933 | Ferris . | |
| 2,129,221 | 9/1938 | Lewis . | |
| 2,745,147 | 5/1956 | Berry . | |
| 2,977,865 | 4/1961 | Irwin | 312/109 X |
| 3,265,118 | 8/1966 | Smith . | |
| 3,308,581 | 3/1967 | Gustavsson . | |
| 3,545,132 | 12/1970 | Hormann et al. . | |
| 3,771,847 | 11/1973 | Aylworth . | |
| 4,035,954 | 7/1977 | Hoff . | |
| 4,375,907 | 3/1983 | Vander Kooi et al. . | |
| 4,516,813 | 5/1985 | Sekerick . | |
| 4,615,570 | 10/1986 | Goodman . | |
| 5,026,130 | 6/1991 | Wright et al. . | |
| 5,050,944 | 9/1991 | Fricano . | |
| 5,172,969 | 12/1992 | Reuter et al. . | |
| 5,409,308 | 4/1995 | Reuter et al. . | |
| 5,524,979 | 6/1996 | Carson et al. . | |
| 5,645,333 | 7/1997 | Sakurai . | |
| 5,758,937 | 6/1998 | Lammens et al. . | |

*Primary Examiner*—Janet M. Wilkens
*Attorney, Agent, or Firm*—Price, Heneveld, Cooper, DeWitt & Litton

[57] ABSTRACT

A cabinet assembly includes a cabinet, a door, sliding hinge structures, a follower, and a mating guide. The cabinet is provided with a front opening. The door is configured to close the front opening. The sliding hinge structures operably support the door on the cabinet for pivotal and sliding movement between a closed position covering the front opening, and an open position uncovering the front opening and storing the door above the cabinet. The follower and the mating guide are separate from the hinge structures and operably attach an upper edge of the door to a front edge of the cabinet. The follower and guide constrain the door to a pivotal movement as the door is initially opened in a manner preventing a sliding guillotine-like movement when the door is initially opened.

22 Claims, 3 Drawing Sheets

CABINET WITH OVER-THE-TOP DOOR

BACKGROUND OF THE INVENTION

The present invention concerns a cabinet assembly, and in particular a cabinet adaptable for use with a removable partition panel having a door that is stored above the cabinet.

Cabinets including an over-the-top door are known and are often preferred over other cabinets because the doors do not strike objects within the cabinet, and further do not take up space within the cabinet when opened. Another benefit is that the top of the cabinet must stay free of clutter because the door prevents use of the space above the cabinet for storage purposes. Such cabinets and doors often use a sliding hinge arrangement, where a pair of hinges are attached to a top and front of the cabinet and a track is attached to a side of the door for both slidably and pivotally engaging the hinge. The door opens by sliding the door upwardly and/or outwardly until the door can be slid onto the top of the cabinet for storage in an open position. For example, see U.S. Pat. No. 3,771,847.

A problem is that these pivot/slide hinged doors can close with guillotine-like motion if the doors are prematurely released when partially open. This results in the doors moving vertically downwardly by gravity with a potentially unsafe speed and force unless proper care is used. Some cabinet manufacturers have conceived of alternatives to reduce the potential or likelihood of such accidental downward movement of the doors. However, the known alternatives are costly, include an unacceptable number of components, are mechanically too complex, and/or are difficult to assemble.

Also, racking and binding of doors can be problematic. When sliding the door between the opened and closed positions, doors may cant, thus binding the door against the cabinet itself or within the mechanisms attaching the door to the cabinet.

Therefore, an apparatus solving the aforementioned problems and having the aforementioned advantages is desired.

SUMMARY OF THE INVENTION

In one aspect of the present invention, a cabinet assembly includes a cabinet having a front opening, a door configured to close the front opening, sliding hinge structures, a follower, and a mating guide separate from the hinge structures. The sliding hinge structures operably support the door on the cabinet for pivotal and sliding movement between a closed position, in which the door covers the front opening, and an open position, in which the door is stored above the cabinet. The follower and mating guide operably attach an upper edge of the door to a front edge of the cabinet. The follower and the guide constrain the door to a pivotal movement as the door is initially opened in a manner so as to prevent a sliding guillotine-like movement while the door is in a partially opened position.

In another aspect of the present invention, a follower and guide are provided in a cabinet assembly having a cabinet and a door. The cabinet includes a front opening and a top panel. The door is configured to cover the front opening. The cabinet further includes hinges that pivotally and slidably mount the door to a front edge of the top panel. The door is movable between a closed position where the door covers the front opening, a pivoted forward/opened position where the door extends horizontally in front of the cabinet, and a stored forward/opened position where the door is located generally parallel to the top panel. The guide extends fore-to-aft in the top panel and is generally centrally located within the top panel and extends to the front edge thereof. The follower is provided on the door separate from the hinges and is both pivoted to the door and slidably engaged with the slide. The door pivots on the follower and the hinges when the door is moved between the closed position and the pivoted forward/opened position. Characteristically, the follower cannot slide when the door is initially pivoted from the closed position, thus preventing the door from moving with a guillotine-like movement when initially pivoted from the closed position. The follower slidably engages the guide when the door is slidingly moved on the hinges between the pivoted forward/opened position and the stored forward/opened position. Characteristically, the door cannot pivot on the follower, nor pivot on the hinges, when the door is slidingly moved from the stored/open position toward the pivoted/opened position. As a result, an over-the-top cabinet door is provided that substantially cannot be moved with a vertical guillotine-like motion as the door is closed.

In yet another aspect of the present invention, the cabinet assembly includes a cabinet, a door, and a door support mechanism. The cabinet is provided with a front opening and includes a top panel. The door is configured to close the front opening and includes a rear surface. The door support mechanism operably mounts the door to the cabinet and is configured to support the door for pivotal movement between a closed position, when the door covers the front opening, and a pivoted forward/opened position, when the door is pivoted open and extends forward of the cabinet. The door support mechanism is further configured to support the door for sliding movement between the pivoted forward/opened position and the stored/opened position where the door is located over the cabinet. The door support mechanism includes a first track and a first follower operably engaging the first track and defining a first axis of rotation and a first path. The door support mechanism further includes second tracks and second followers operably engaging the second tracks and defining a second axis of rotation and a second path. The first tracks and second followers are attached to one of the cabinet and the door. The second tracks and first followers are attached to the other of the cabinet and the door. The tracks and the followers are located so as the first and second paths extend in substantially perpendicular directions when the door is in the closed position, the first and second paths are coplanar and align when the door is between the pivoted forward/opened position and stored/opened position. The first and second tracks and first and second followers are further located so that the first and second axes are co-axially aligned only when in or between the closed position and pivoted forward/opened position, but are misaligned when in or close to the stored forward/opened position. The door is limited to a pivoting motion when the door is between the closed position and the pivoted forward/opened position and is limited to a sliding motion when the door is between the pivoted forward/opened position and the stored/opened position.

These and other features, advantages, and objects of the present invention will be further understood and appreciated by those skilled in the art by reference to the following specification, claims, and appended drawings.

DETAILED DESCRIPTION OF PREFERRED EMBODIMENTS

Figure 1:
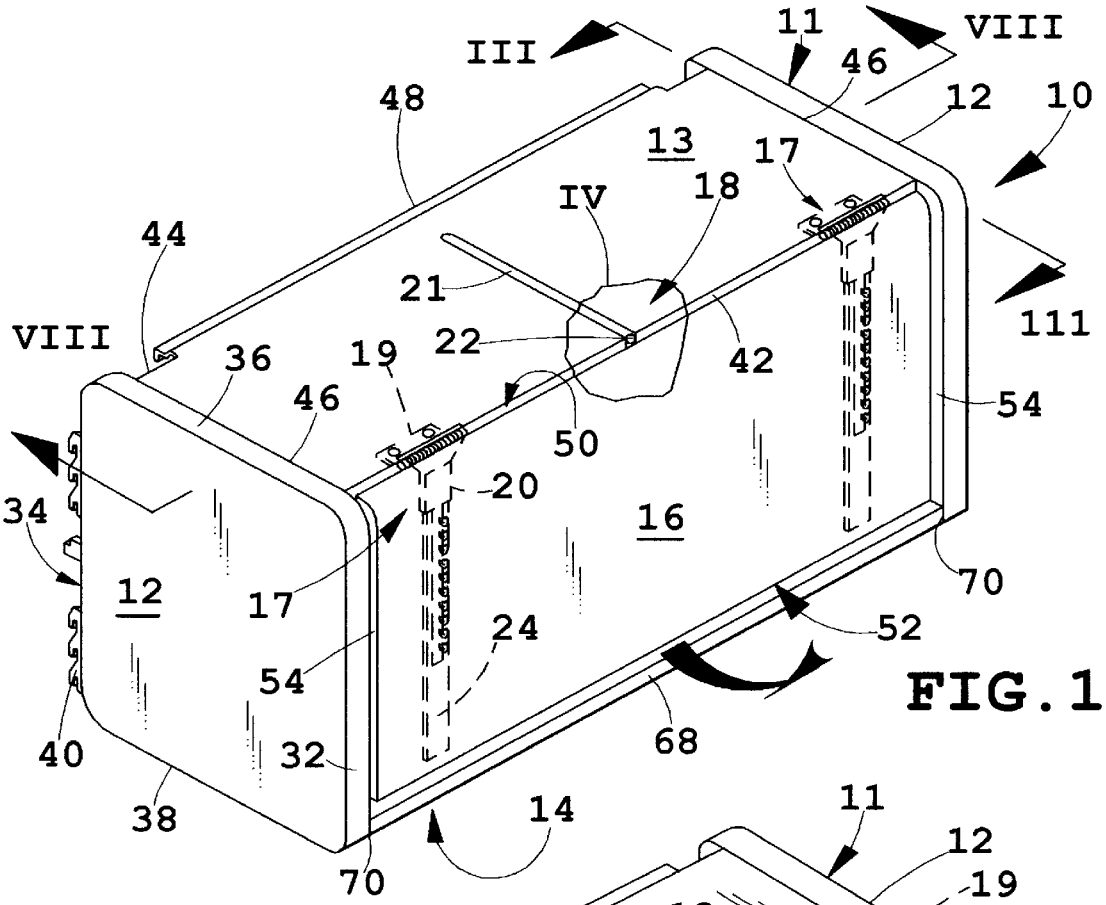
FIG. 1 is a perspective view of a cabinet with an over-the-top door embodying the present invention, with the door in the closed position.

For purposes of description herein, the terms "upper," "lower," "right," "left," "rear," "front," "vertical," "horizontal," and derivatives thereof shall relate to the invention as oriented in FIG. 1. However, it is to be understood that the invention may assume various orientations and step sequences, except where expressly specified to the contrary. It is also to be understood that the specific devices and processes illustrated in the attached drawings and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

The reference numeral 10 (FIG. 1) generally designates a panel-mounted storage cabinet assembly embodying the present invention. The illustrated panel-mounted storage cabinet assembly 10 includes a cabinet assembly 11 formed by side panels 12, a top panel 13, and a bottom panel 14 that define a storage area 15. An over-the-top door 16 is mounted to the cabinet 11 for closing a front opening of the storage area 15. The door 16 is operably mounted to the cabinet 11 by a pair of track-and-hinge assemblies 17 and by a guide-and-follower assembly 18, so that the door 16 opens onto top panel 13 of the cabinet 11, as described below. Advantageously, the interaction of the track-and-hinge assemblies 17 and the guide-and-follower assembly 18 cause the door 16 to initially open with a pivoting motion, and then cause the door 16 to slide horizontally to a storage position over the cabinet assembly 11. By this arrangement, the door 16 is prevented from moving with a sudden guillotine-like motion when the door 16 is near the closed position, which is an advantage desired by some consumers, as discussed below.

Figure 2:
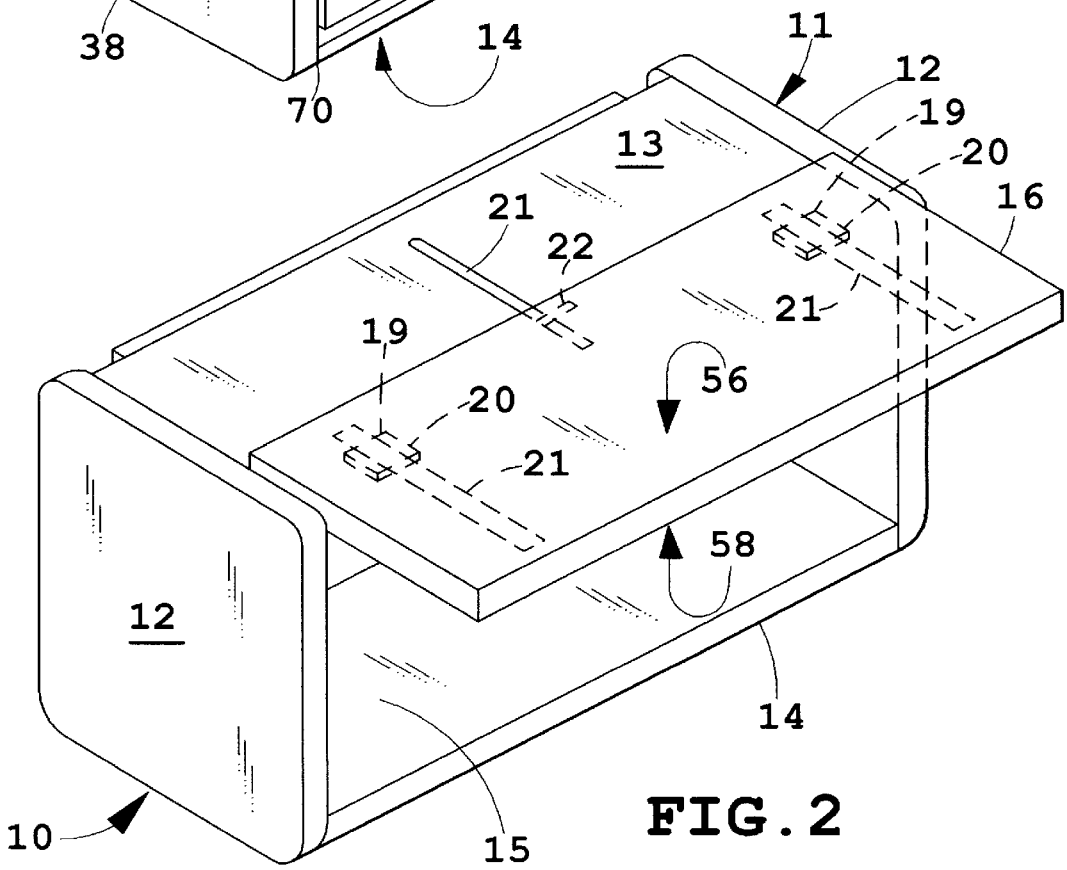
FIG. 2 is a perspective view of the cabinet with the door in the pivoted/open position.

Cabinet assembly 11 (FIGS. 1 and 2) is formed by side panels 12, top panel 13, and bottom panel 14 defining a storage area 15 that has a substantially rectangular shape. Cabinet assembly 11 also includes a back panel 30. The illustrated side panels 12, top panel 13, and bottom panel 14 are constructed of steel; however, it is contemplated that other appropriate materials may be used including, but not limited to, wood, aluminum, and durable plastics.

Figure 3:
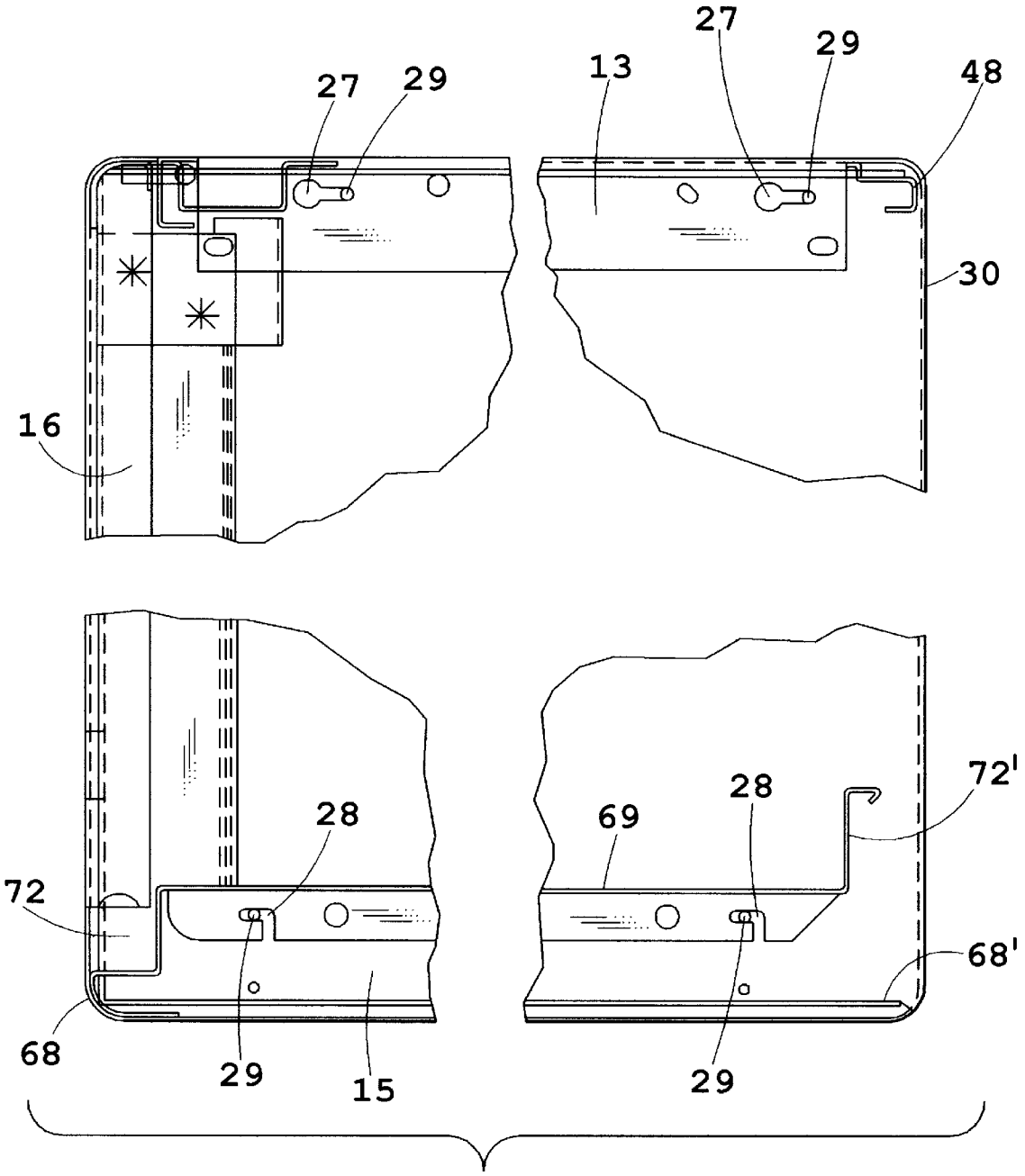
FIG. 3 is a cross-sectional view of the cabinet taken along the line III—III in FIG. 1.

Side panels 12 (FIGS. 1–3) are each defined by a front edge 32, a rear edge 34, a top edge 36, and a bottom edge 38. Side panels 12 are each provided with a plurality of mounting hooks 40 along rear edge 34 for removably mounting the cabinet assembly 11 to a partition panel (not shown). Side panels 12 are provided with inwardly facing keyhole slots 27 and inwardly facing notches 28.

Top panel 13 is defined by front edge 42, rear edge 44, and side edges 46. Rear edge 44 of top panel 13 is provided with a rearwardly extending L-shaped rail 48 for rigidifying the cabinet assembly 11. Top panel 13 is further provided with hanging pins 29 that extend outwardly from side edges 46. Top panel 13 is attached to the side panels 12 by engaging the hanging pins 29 within the keyhole slots 27 of side panels 12.

Bottom panel 14 includes a front edge 68, a rear edge 68', and side edges 70. Bottom panel 14 includes a shelf 69 defining a forwardly facing notch 72 running along front edge 68 and a rear flange 72' defining a rear stop for the shelf. Bottom panel 14 is further provided with hanging pins 29 that extend outwardly from side edges 70. Bottom panel 14 is attached to side panels 12 by engaging the hanging pins 29 within the notches 28 of side panels 12. Other methods of attachment that are appropriate for the materials used to construct the cabinet assembly are envisioned.

Door 16 (FIGS. 1 and 2) defines a top edge 50, a bottom edge 52, side edges 54, a front surface 56, and a rear surface 58. The door 16 is mounted to the cabinet 11 for closing the storage area 15. Door 16 is operable between a closed position (FIG. 1), a pivoted forward/opened position (see FIG. 2, although in FIG. 2 the door is shown as having been slid rearwardly an inch), and a stored/opened position in which the door 16 is slid completely rearwardly such that it is positioned over the top panel 13 (not shown).

Door 16 is operably mounted to cabinet assembly 11 by track-and-hinge assemblies 17. Exemplary track-and-hinge assemblies 17 that can be used in the present invention are disclosed within U.S. Pat. No. 3,771,847 (Reissue Patent No. 28,994). Such assemblies are available in the industry.

The track-and-hinge assemblies 17 (FIG. 1) each include a stationary hinge member 19 attached to the top of panel 13, a pivot hinge member 20 that is pivotally attached to the stationary hinge member 19 by way of a hinge pin (not shown) defining a first axis of rotation, and a track 24 attached to the rear surface 58 of door 16 that slidably engages the pivot hinge member 20. More specifically, the sliding mechanism includes a first rail, a second rail, and a plurality of ball bearings seated therebetween (not shown). The first rail operably slides in a linear motion within the second rail.

Figure 4:
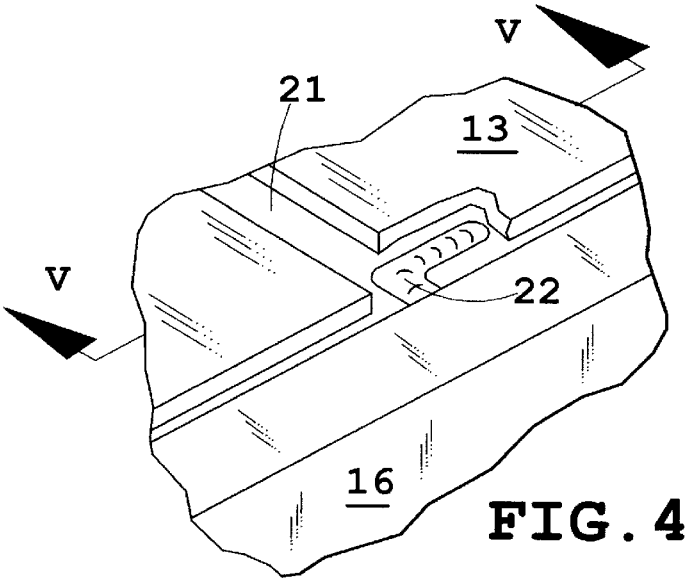
FIG. 4 is an enlarged fragmentary cross-sectional view of a follower and guide taken of area IV in FIG. 1.
Figure 5:
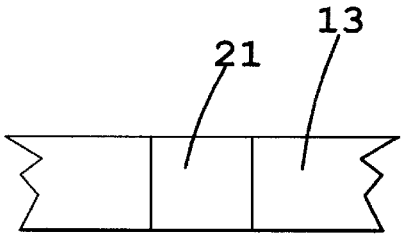
FIG. 5 is an enlarged fragmentary cross-sectional view of a slot taken along line V—V in FIG. 4.

The guide-and-follower assembly 18 (FIGS. 1 and 4) prevents the door 16 from being moved with a sudden guillotine-like motion when the door 16 is near the closed position. The guide-and-follower assembly 18 includes a slot 21 formed within top panel 13, and a guide member 22 that rearwardly extends from rear surface 58 of door 16. The slot 21 is centrally located within the top panel 13, extends through the entire thickness of top panel 13, and extends rearwardly from front edge 42 towards rear edge 44. However, the slot 21 may be located at any location along the top panel 13. The guide member 22 is provided a proximal end 25 that rearwardly projects from the rear surface 58 of door 16, and a distal end 26 for engagement under top wall 13. The illustrated guide member 22 (FIG. 4) is a bent bar that is curved at an approximate 90° angle; however, other angles that provide substantial contact between the guide member 22 and the top panel 13 can be used and still be within the scope of the present invention.

In operation, the door 16 (FIGS. 1, 2, 4, and 5) is pivotable between the closed position, the open/pivoted position, and the open/stored position. The guide member 22 prevents travel of the door in a linear motion along the tracks 24 of the track-and-hinge assemblies 17 until the door 16 has been pivoted to a substantially coplanar position with the top panel 13. The interaction of the track-and-hinge assemblies 17 and the guide-and-follower assembly 18 cause the door 16 to initially open with a pivot motion, and then allow the door 16 to slide horizontally to a stored position over the cabinet assembly 11. The door 16 is prevented from moving with a sudden guillotine-like motion when the door is near the closed position as a result of the contact between the guide member 22 and top panel 13. When in the closed position, the bottom edge 52 of door 16 is loosely seated within notch 72 of bottom panel 14, such that door 16 sits flush with front edges 32 of side panels 12.

Figure 6:
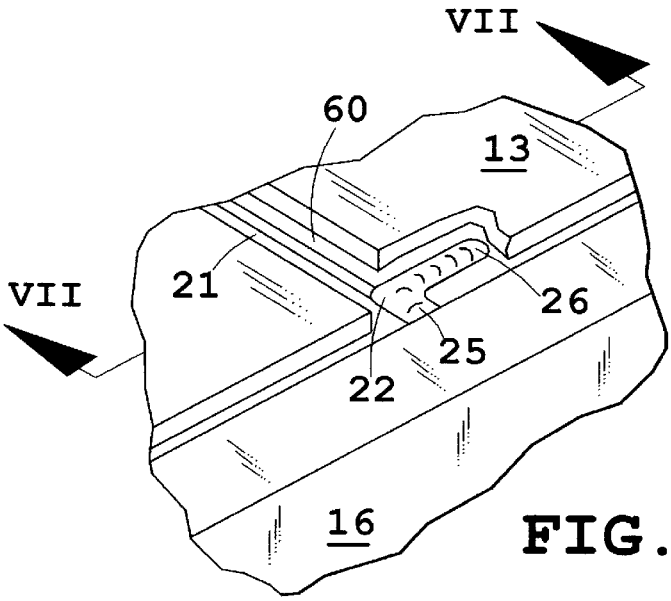
FIG. 6 is an enlarged fragmentary cross-sectional view of a modified follower and guide taken of area VI in FIG. 1.
Figure 7:
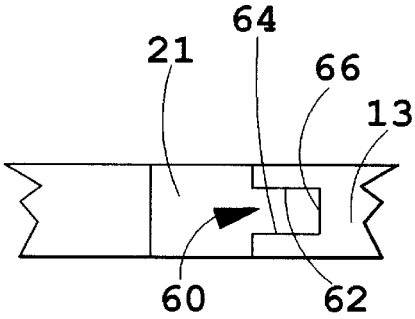
FIG. 7 is an enlarged fragmentary cross-sectional view of a groove taken along line VII—VII in FIG. 6.

An alternative embodiment to the guide and follower assembly 18 (shown in FIGS. 4 and 5) includes a groove 60 that is formed within slot 21 and extends laterally into top panel 13 (FIGS. 6 and 7). The groove 60 is defined by a top wall 62, a bottom wall 64, and an inner wall 66.

In operation, the distal end 26 of guide member 22 travels in a linear path within the groove 60. The door is prevented from moving with a sudden guillotine-like motion when the door 16 is near the closed position as a result of the contact of the guide member 22 with the top wall 62 of groove 60.

Figure 8:
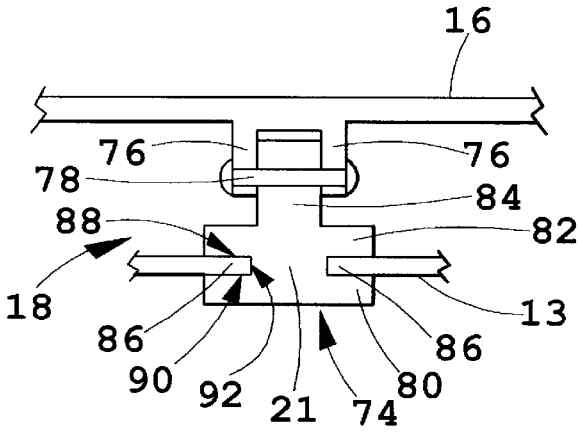
FIG. 8 is an enlarged fragmentary cross-sectional view of another modified follower and guide taken along line VIII—VIII in FIG. 1.

In yet another embodiment of the present invention (FIGS. 1 and 8), the guide-and-follower assembly 18 includes a slot 21 formed within top panel 16, a guide member 74, a set of pivot arms 76 which extend inwardly from door 16, and a pivot pin 78. Slot 21 is centrally located within the top panel 13 and extends rearwardly from front edge 42 towards rear edge 44. The slot 21 defines opposing flanges 86 within top panel 13. The flanges 86 are defined by a top surface 88, a bottom surface 90, and an inside surface 92. An "I" shaped guide member 74 is provided having a pair of laterally extending lower flanges 80, a pair of laterally extending upper flanges 82, and a pivot arm 84. Guide member 74 is located within slot 21, such that top panel 16 is positioned between the lower flanges 80 and the upper flanges 82 allowing guide member 74 to travel linearly along slot 21 without binding or rotating within slot 21. The pivot arm 84 of guide member 74 is pivotally connected to the set of pivot arms 76 by the pivot pin 78, thus defining a second axis of rotation. Guide member 74 is constructed of lubricious plastic or other suitable material.

In operation, the door 16 is pivoted between the closed position, the open/pivoted position, and the open/stored position. The guide member 74 prevents travel of the door in a linear motion along the tracks 24 of the track-and-hinge assemblies 17 until the door has been pivoted to a substantial coplanar position with top panel 13. Once the door 16 is pivoted to a coplanar position with top panel 13, the guide member 74 may travel along slot 21, thus allowing door 16 to be positioned above top panel 13.

In the foregoing description, it will be readily appreciated by persons skilled in the art that modifications may be made to the invention without departing from the concepts disclosed herein. For example, it is contemplated that the track-and-hinge assemblies 17 could be replaced with a slot (like slot 21) located in the door 16 and a follower/guide member (like guide member 22) located at a front edge of the top panel 13. Such modifications are to be considered as included in the following claims, unless these claims by their language expressly state otherwise.

The invention claimed is:

1. A cabinet assembly comprising:

a cabinet having a front opening and including a top panel;

a door configured to close the front opening;

sliding hinge structures operably supporting the door in the cabinet for pivotal and sliding movement between a closed position covering the front opening, and an open position uncovering the front opening and storing the door above the cabinet; and a follower and a mating guide separate from the hinge structures that operably attach an upper edge of the door to a front edge of the cabinet, the follower and guide constraining the door to a pivotal movement as the door is initially opened in a manner preventing a sliding guillotine-like movement while the door is in a partially opened position.

2. The cabinet assembly defined in claim 1 wherein the guide includes a slot formed within the top panel.

3. The cabinet assembly defined in claim 2 wherein the follower is operably engaged with the slot.

4. The cabinet assembly defined in claim 3 wherein the follower is defined by a bent rod.

5. The cabinet assembly defined in claim 2 wherein the slot comprises a groove with a side recess.

6. The cabinet assembly defined in claim 5 wherein the follower is engaged within the side recess of the groove.

7. The cabinet assembly defined in claim 1 wherein the guide is defined by opposing edge flanges, the opposing edge flanges each having a top surface, a bottom surface, and an inside surface, the follower including opposing faces shaped to slidably engage the top, bottom, and inside surfaces of the opposing edge flanges.

8. In a cabinet assembly including a cabinet and a door, the cabinet having a front opening and a top panel with the door being configured to cover the front opening, and including hinges pivotally and slidably mounting the door to a front edge of the top panel, the door being movable between a closed position where the door covers the front opening, a pivoted/opened position where the door extends horizontally in front of the cabinet, and a stored/opened position where the door is located generally parallel the top panel, an improvement comprising:

a guide extending fore-to-aft in the top panel, the guide being generally centrally located in the top panel and extending to the front edge thereof; and a follower on the door separate from the hinges that is both pivoted to the door and slidably engaged with the guide, the door pivoting on the follower and the hinges when the door is moved between the closed position and the pivoted/opened position, but characteristically the follower not sliding when the door is initially pivoted from the closed position, and further characteristically the follower preventing the door from moving with a guillotine-like movement when initially pivoted from the closed position, the follower slidably engaging the guide when the door is slidingly moved on the hinges between the pivoted/opened position and the stored/opened position but characteristically the door not pivoting on the follower, nor pivoting on the hinges, when the door is initially slidingly moved from the stored/opened position;

whereby an over-the-top cabinet door is provided that substantially cannot be moved with a vertical guillotine-like motion as the door is closed.

9. The cabinet assembly defined in claim 8 wherein the guide is a slot formed within the top panel.

10. The cabinet assembly defined in claim 9 wherein the follower is engaged through the slot.

11. The cabinet assembly defined in claim 10 wherein the follower is defined by a bent rod.

12. The cabinet assembly defined in claim 9 wherein the slot is a groove.

13. The cabinet assembly defined in claim 12 wherein the follower is engaged within the groove.

14. The cabinet assembly defined in claim 13 wherein the follower is formed of a lubricious plastic.

15. The cabinet assembly defined in claim 8 wherein the guide is defined by opposing edge flanges, the opposing edge flanges each having a top surface, a bottom surface, and an inside surface, the follower including opposing faces shaped to slidably engage the top, bottom, and inside surfaces of the opposing edge flanges.

16. A cabinet assembly comprising:

a cabinet having a front opening and including a top panel;

a door configured to close the front opening and including a rear surface; and a door support mechanism operably mounting the door on the cabinet, the door support mechanism being configured to support the door for pivotal movement between a closed position where the door covers the front opening and a pivoted/opened position where the door is pivoted open and extends forward of the cabinet, and further being configured to support the door for sliding movement between the pivoted/opened position and a stored/opened position where the door is located over the cabinet, the door support mechanism including a first track and a first follower operably engaging the first track and defining a first axis of rotation and a first path, and including second tracks and second followers operably engaging the second tracks and defining a second axis of rotation and a second path, the first tracks and the second follower being attached to one of the cabinet and the door, and the second tracks and first followers being attached to the other of the cabinet and the door, the tracks and followers being located so that the first and second paths extend in substantially perpendicular directions when the door is in the closed position, but so that the first and second paths are coplanar and aligned when the door is between the pivoted/opened position and stored/opened position, and further the first and second tracks and the first and second followers being located so that the first and second axes are co-axially aligned only when in or between the closed position and pivoted/opened position, but are misaligned when in or close to the stored/opened position, whereby the door is limited to a pivoting motion when the door is between the closed position and the pivoted/opened position, and whereby the door is limited to a sliding motion when the door is between the pivoted/opened position and the stored/opened position.

17. The cabinet assembly defined in claim 16 wherein the second tracks are a attached to the door and the second followers are a sliding-type hinge.

18. The cabinet assembly defined in claim 17 wherein the first track is located atop the top panel.

19. The cabinet assembly defined in claim 18 wherein the first track is a slot formed within the top panel.

20. The cabinet assembly defined in claim 19 where in the first follower is a lubricious bearing member that slidably engages the slot.

21. The cabinet assembly defined in claim 20 wherein the first track is centrally located within the top panel and is oriented in a fore-to-aft direction.

22. The cabinet assembly defined in claim 16 wherein the first track is centrally located within the top panel and is oriented in a fore-to-aft direction.

* * * * *

UNITED STATES PATENT AND TRADEMARK OFFICE

CERTIFICATE OF CORRECTION

PATENT NO. : 6,007,171
DATED : December 28, 1999
INVENTOR(S) : Carolyn May Varellas-Olree It is certified that error appears in the above-identified patent and that said Letters Patent is hereby corrected as shown below:

Column 7, claim 16, line 31;

After "first" change "tracks" to --track--

Column 7, claim 16, line 31;

"second followers" should be --second follower--;

Column 7, claim 16, line 34;

"followers" should be --follower--.

Signed and Sealed this

Thirtieth Day of January, 2001

*Attest:*

Q. TODD DICKINSON

*Attesting Officer*

*Director of Patents and Trademarks*